US010472216B2

(12) United States Patent
Ripperda et al.

(10) Patent No.: US 10,472,216 B2
(45) Date of Patent: Nov. 12, 2019

(54) RAILCAR VIBRATOR LIFTER

(71) Applicant: Arnco Solutions, Trenton, IL (US)

(72) Inventors: Jon Norbert Ripperda, Trenton, IL (US); Jerome Bernard Ripperda, Trenton, IL (US)

(73) Assignee: Arnco Solutions, Trenton, IL (US)

( * ) Notice: Subject to any disclaimer, the term of this patent is extended or adjusted under 35 U.S.C. 154(b) by 405 days.

(21) Appl. No.: 15/211,405

(22) Filed: Jul. 15, 2016

(65) Prior Publication Data

US 2017/0015510 A1 Jan. 19, 2017

Related U.S. Application Data

(60) Provisional application No. 62/193,945, filed on Jul. 17, 2015.

(51) Int. Cl.
*B66F 9/22* (2006.01)
*B61D 7/32* (2006.01)
*B66F 11/00* (2006.01)

(52) U.S. Cl.
CPC ..... *B66F 9/22* (2013.01); *B66F 11/00* (2013.01)

(58) Field of Classification Search
CPC .... B66F 9/22; B66F 11/00; B66F 7/00; B66F 7/10; B66F 7/22; B66F 9/20; B61D 7/32
See application file for complete search history.

(56) References Cited

U.S. PATENT DOCUMENTS 2,621,813 A * 12/1952 Bauerle ..... B65D 88/66 222/196
2,673,651 A * 3/1954 Plant ..... B61D 7/30 105/451
4,715,180 A * 12/1987 Rosman ..... B66D 1/08 60/372
4,796,029 A * 1/1989 Duppong ..... B66F 7/22 269/58
5,810,548 A * 9/1998 Stenudd ..... A61G 7/08 212/255
7,478,989 B2 1/2009 Ash
10,226,684 B2 * 3/2019 Collins ..... A63C 19/12
2007/0292252 A1 * 12/2007 McGill ..... B62B 3/008 414/634
2008/0003085 A1 * 1/2008 Ash ..... B61D 7/32 414/375
2011/0089389 A1 * 4/2011 Weber ..... B66F 3/24 254/3 B
2013/0101383 A1 * 4/2013 Lynch, Jr. ..... B66F 11/00 414/800
2014/0261101 A1 * 9/2014 Hurd ..... A47B 97/00 108/50.11
2014/0263472 A1 9/2014 Winsor
2019/0010037 A1 * 1/2019 Jaipaul ..... B66F 3/46

OTHER PUBLICATIONS

Railcar Unloading Solutions, "Manual Lift Cart for Rail Car Portable Vibrators", Navco, Houston, TX, Bulletin 4000.404 (Nov. 12, 2014), 2 pages.

* cited by examiner

*Primary Examiner* — Sarang Afzali
*Assistant Examiner* — Darrell C Ford
(74) *Attorney, Agent, or Firm* — Behmke Innovation Group LLC; James Behmke; Stephen D. LeBarron

(57) ABSTRACT

According to one or more embodiments, a lifter for a railcar vibrator is described. In some cases, the vibrator lifter is operable to position a railcar vibrator onto a hopper railcar and facilitate removal of the vibrator therefrom.

17 Claims, 17 Drawing Sheets

RAILCAR VIBRATOR LIFTER

CROSS-REFERENCE TO RELATED APPLICATION

This application claims the benefit of U.S. Provisional Application Ser. No. 62/193,945 filed Jul. 17, 2015, the disclosure of which is incorporated herein by reference.

TECHNICAL FIELD

The present disclosure relates generally to railcar vibrators and, more particularly, to a pneumatically powered lifter for a railcar vibrator.

BACKGROUND

Hopper railcars are often used to carry a variety of goods such as grain, coal, gravel, ore, and the like. A hopper railcar typically includes a wide top opening for ease of loading cargo into the railcar for transport. In addition, many hopper railcars include one or more narrower openings on their undersides, to facilitate unloading of the cargo. In particular, the one or more narrower openings may be closed to retain the cargo during transport and opened at the destination, to allow the cargo to be unloaded.

Depending on the type of cargo and the configuration of the hopper car, a bottleneck condition may arise whereby the cargo can get stuck in one of the narrower, bottom openings of the hopper car. To prevent such bottlenecks from occurring, hopper vibrators have been devised that shake the bottom opening of the railcar during unloading of cargo. In doing so, any cargo that becomes momentarily stuck in the bottom opening may be shaken loose, thereby alleviating the bottleneck.

Typically, the attachment and detachment of a railcar vibrator to and from a hopper railcar requires manual intervention by a railway worker. While railcar vibrators and their attachment brackets are somewhat portable, they may still weigh as much as one hundred and sixty five pounds, for example. Thus, railcar vibrators are often difficult to lift and position into the corresponding retaining bracket on the railcar. In addition, after the cargo has been unloaded, vibrators often become stuck in the retaining bracket of the railcar, making it difficult to remove a vibrator manually.

SUMMARY

According to one or more embodiments of the disclosure as described in greater detail below, a lifter for a railcar vibrator is described. In some cases, the vibrator lifter uses a pneumatic over hydraulic system to position a railcar vibrator onto a hopper railcar and facilitate removal of the vibrator therefrom.

BRIEF DESCRIPTION OF THE DRAWINGS

The foregoing and other objects, features, aspects and advantages of the embodiments disclosed herein will become more apparent from the following detailed description when taken in conjunction with the following accompanying drawings.

FIG. 2A is a first example, and FIG. 2B is a second example of a railcar vibrator both of which are capable of being lifted by the various embodiments described herein.

FIG. 3A illustrates an exemplary perspective view of the railcar vibrator lifter, FIG. 3B illustrates an exploded view of exemplary retention structures of the railcar vibrator lifter of FIG. 3A and FIG. 3C illustrates a side view of the exemplary railcar vibrator lifter of FIG. 3A.

FIG. 4A is a side view of the first subassembly, FIG. 4B is a front view of the first subassembly, and FIG. 4C is a top view of the first subassembly according to the various embodiments.

FIG. 5A is a side view of the second subassembly, FIG. 5B is a front view of the second subassembly, and FIG. 5C is a top view of the second subassembly according the various embodiments.

FIG. 6A is a side view of the third subassembly, FIG. 6B is a front view of the third subassembly, and FIG. 6C is a top view of the third subassembly according the various embodiments.

FIG. 7A is a side view of the completed lifter assembly, FIG. 5B is a front view of the completed lifter assembly, and FIG. 5C is a top view of the completed lifter assembly according the various embodiments.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DESCRIPTION OF EXAMPLE EMBODIMENTS

The techniques described herein provide for a railcar vibrator lifter that facilitates the positioning of a railcar vibrator onto a hopper railcar and removal of the vibrator therefrom. In some aspects, hydraulic controls are introduced that allow a railway worker to adjust the height and/or angle of the railcar vibrator. In further aspects, a wheelbase and frame configuration is disclosed that provides enhanced support for the railcar vibrator during transport.

Figure 1:
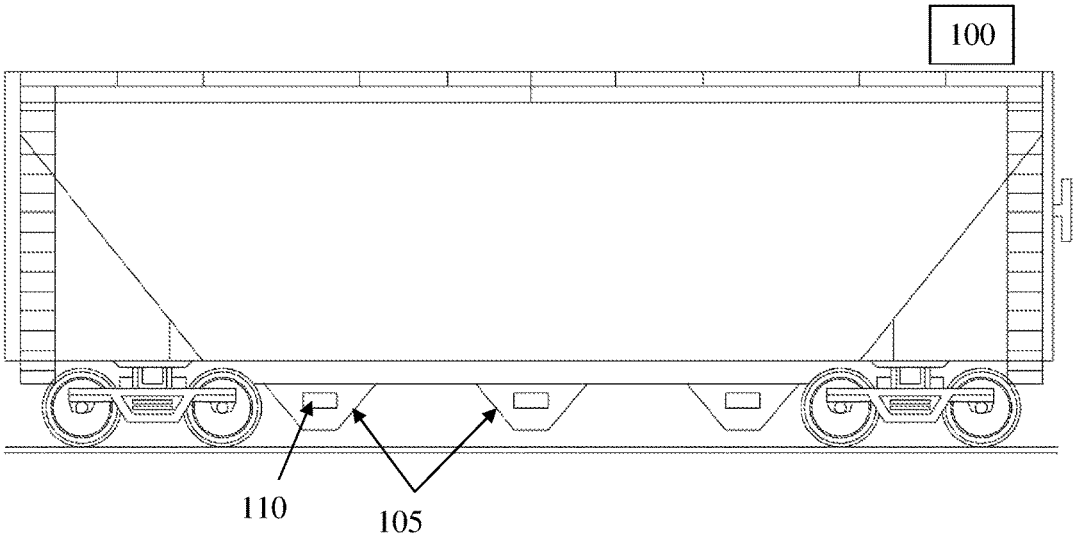
FIG 1 PRIOR ART
FIG. 1 illustrates an example hopper railcar, according to various embodiments.

Referring now to FIG. 1, a hopper railcar 100 is shown, according to various embodiments. Generally, hopper railcar 100 may be wider at its top than at its bottom and define an internal storage space in which cargo may be stored during transport. The top of hopper railcar 100 may define an opening into the internal storage space, thereby allowing cargo to be top loaded into the storage space. In some cases, a covering may then be placed onto the top of hopper railcar 100, to protect and retain the stored cargo. In other cases, certain cargo may remain exposed during transport.

At the bottom of hopper car 100 may be one or more unloading mechanisms 105. Any particular unloading mechanisms 105 may define a hollow passageway connected to the storage space of hopper railcar 100. When in a closed position, the passageway of unloading mechanism 105 may retain the cargo within hopper railcar 100, such as during transport of the cargo. When in an open position, however, obstruction of the passageway of the unloading mechanism 105 may be removed, thereby allowing the cargo to pass through the unloading mechanism 105 (e.g., due to the effects of gravity on the cargo).

In various embodiments, retainers 110 may be coupled to unloading mechanisms 105. In general, a retainer is configured to receive and retain a railcar vibrator during use. Such a vibrator, when coupled to an unloading mechanism, may provide vibrational force to the unloading mechanism to dislodge any cargo that may become stuck within the passageway of the unloading mechanism. For example, retainer 110 may be a bracket or other known form of retainer that is affixed to the external wall of unloading mechanism 105 via welding, bolts, rivets, or any other attachment means.

Figure 2A:
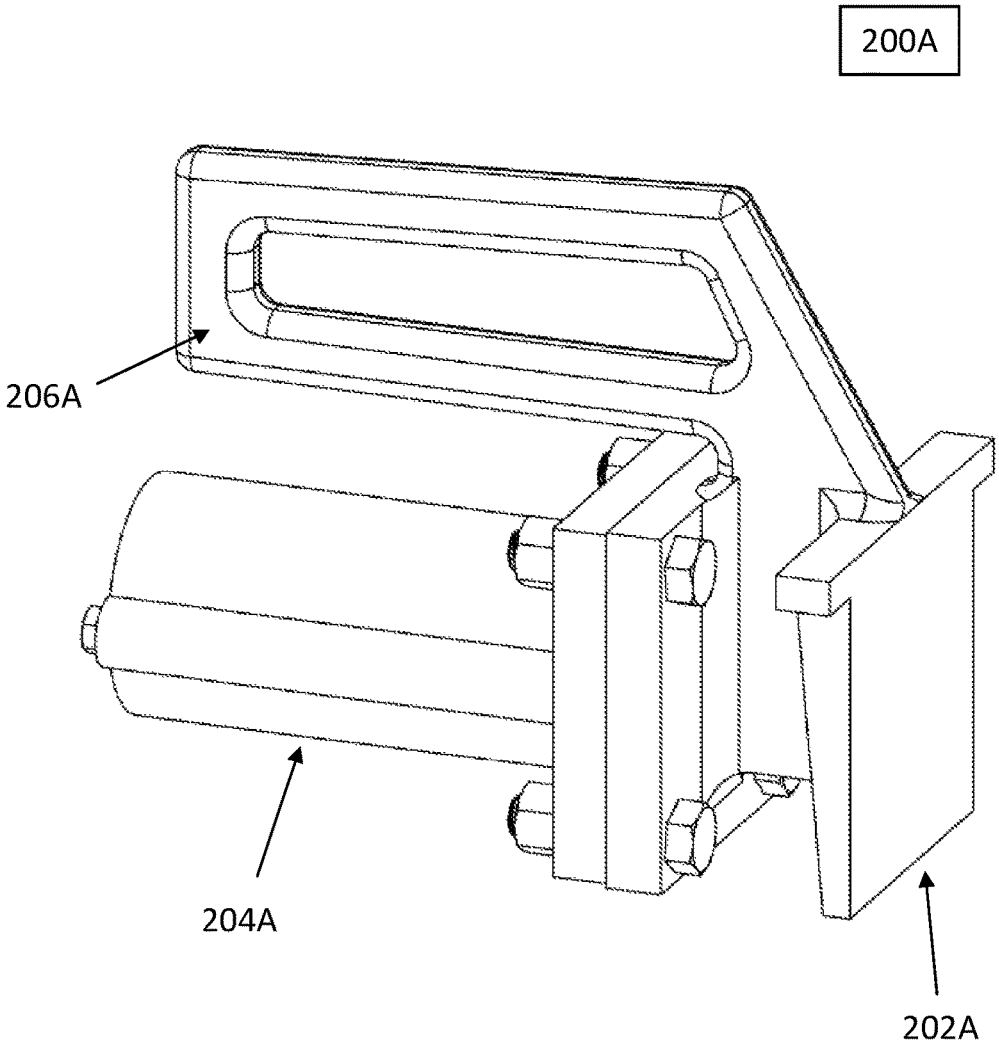
FIGS. 2A-2B illustrate example railcar vibrators, according to various embodiments

Referring now to FIG. 2A, an example railcar vibrator 200A is shown, according to various embodiments. As shown, railcar vibrator 200A may include a front portion 202A configured to engage a retainer (e.g., retainer 110) mounted onto an unloading mechanism of a hopper railcar (e.g., unloading mechanism 105 of hopper railcar 100). For example, as shown, front portion 202A may be slid downward into a retaining bracket on the hopper railcar, to couple railcar vibrator 200A to the railcar.

Railcar vibrator 200A may also include a housing 204A in which the vibrational mechanism is located (e.g., a piston-based mechanism, etc.). During operation, pressure (e.g., pneumatic, hydraulic, etc.) may be provided to the internal pathway of housing 204A via a fitting extending through housing 204A, thereby causing railcar vibrator 200A to vibrate. When railcar vibrator 200A is coupled to the hopper railcar, this vibration force may be transferred into the unloading mechanism of the railcar, thereby vibrating the cargo within the unloading mechanism, to shake any cargo loose that may be stuck during unloading of the cargo.

Typically, housing 204A of railcar vibrator 200A may include a handle structure, such as handle 206A as shown to allow a railway worker to lift and position railcar vibrator 200A into, and out of, the vibrator retainer on the hopper railcar. To accommodate the forces involved during use, however, railcar vibrator 200A may be constructed using a relatively dense and heavy material, such as steel or the like. As a result, typical railcar vibrators may weigh upwards of one hundred and sixty five pounds, making railcar vibrators cumbersome and potentially hazardous to railway workers.

Figure 2B:
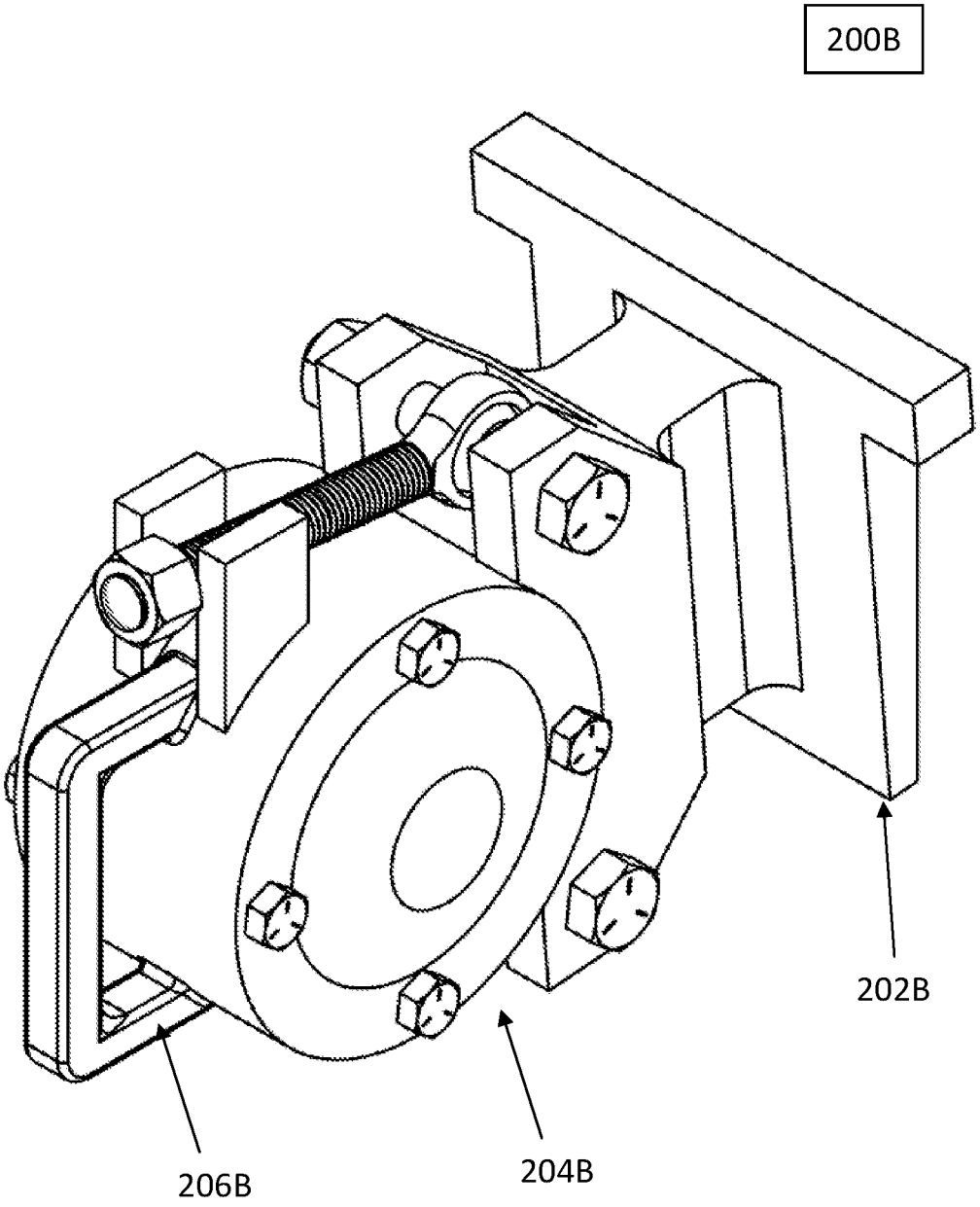

In FIG. 2B, an alternative railcar vibrator 200B is shown, in some embodiments. Generally, railcar vibrator 200B may be of a rotary style, whereas vibrator 200A shown in FIG. 2A may be a piston style vibrator. As would be appreciated, any number of different types of railcar vibrators may be used in accordance with the teachings herein.

Similar to vibrator 200A shown in FIG. 2A, vibrator 200B may include a front portion 202B configured to engage a retainer, such as a retaining bracket, located on a hopper railcar (e.g., by sliding front portion 202B into the bracket, thereby removably attaching vibrator 200B to the railcar). Vibrator 200B may also include housing 204B that houses a vibration mechanism, such as a rotary style vibration mechanism, along with an optional handle, 206B. During operation, pressure provided via a fitting extending through housing 204B may cause the rotary mechanism to rotate and, as a result, vibrator 200B to vibrate.

Figure 3A:
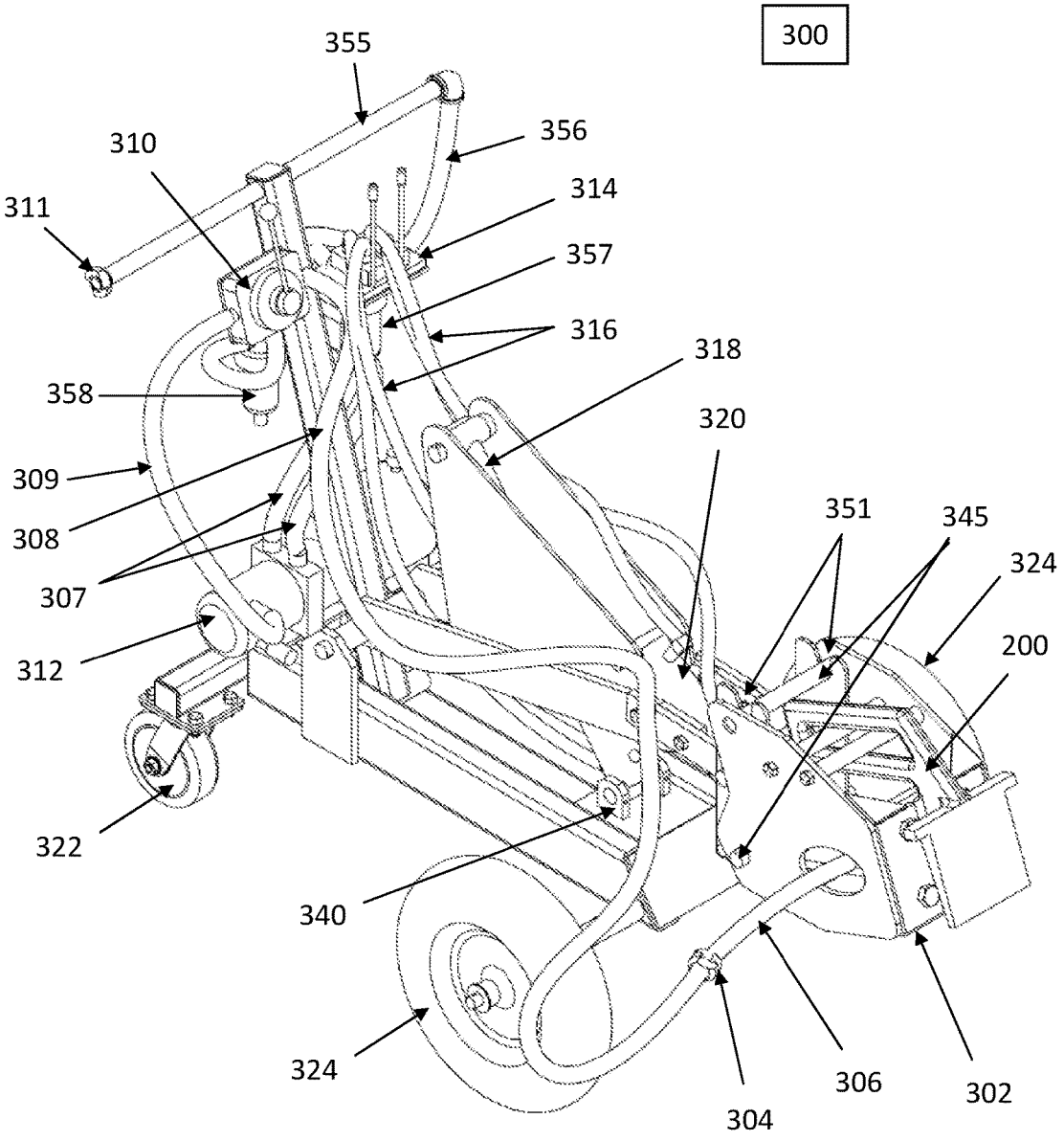
FIGS. 3A-3C illustrate example views of a railcar vibrator lifter, according to various embodiments.
Figure 3B:
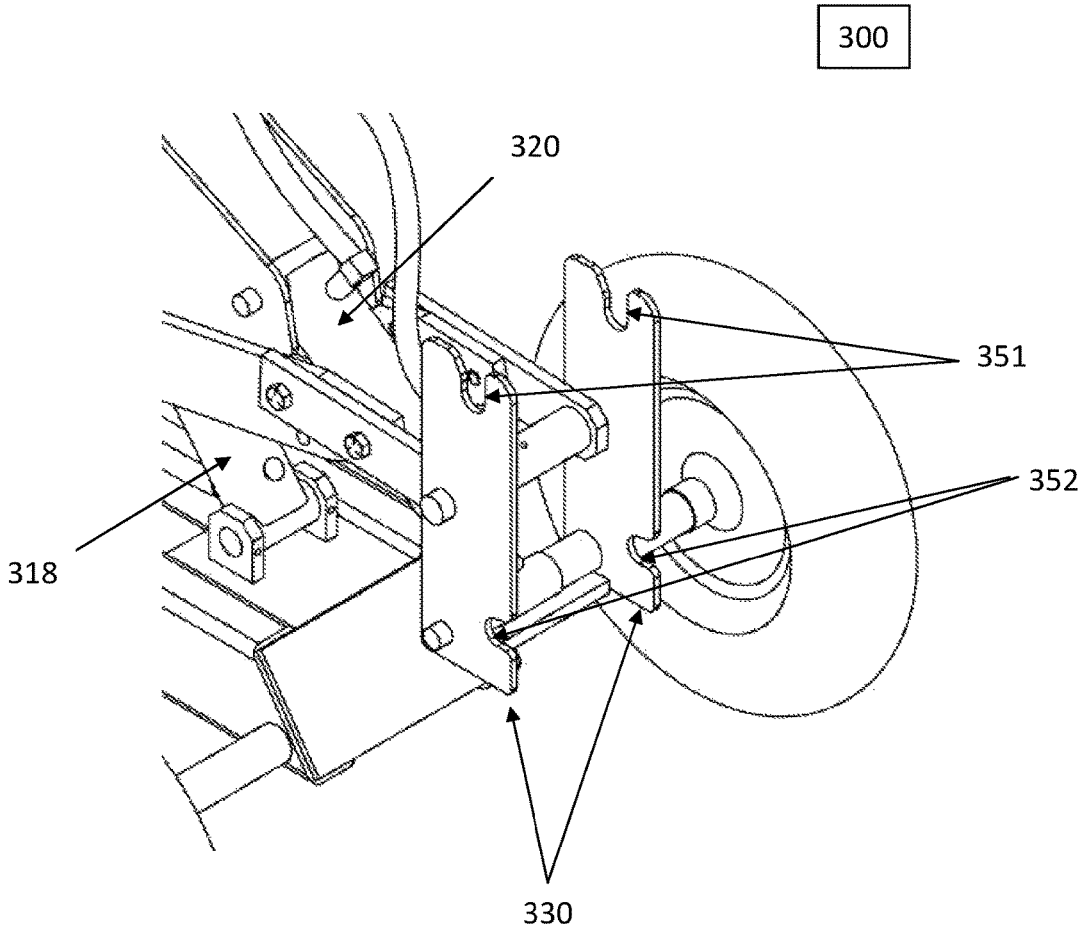
Figure 3C:
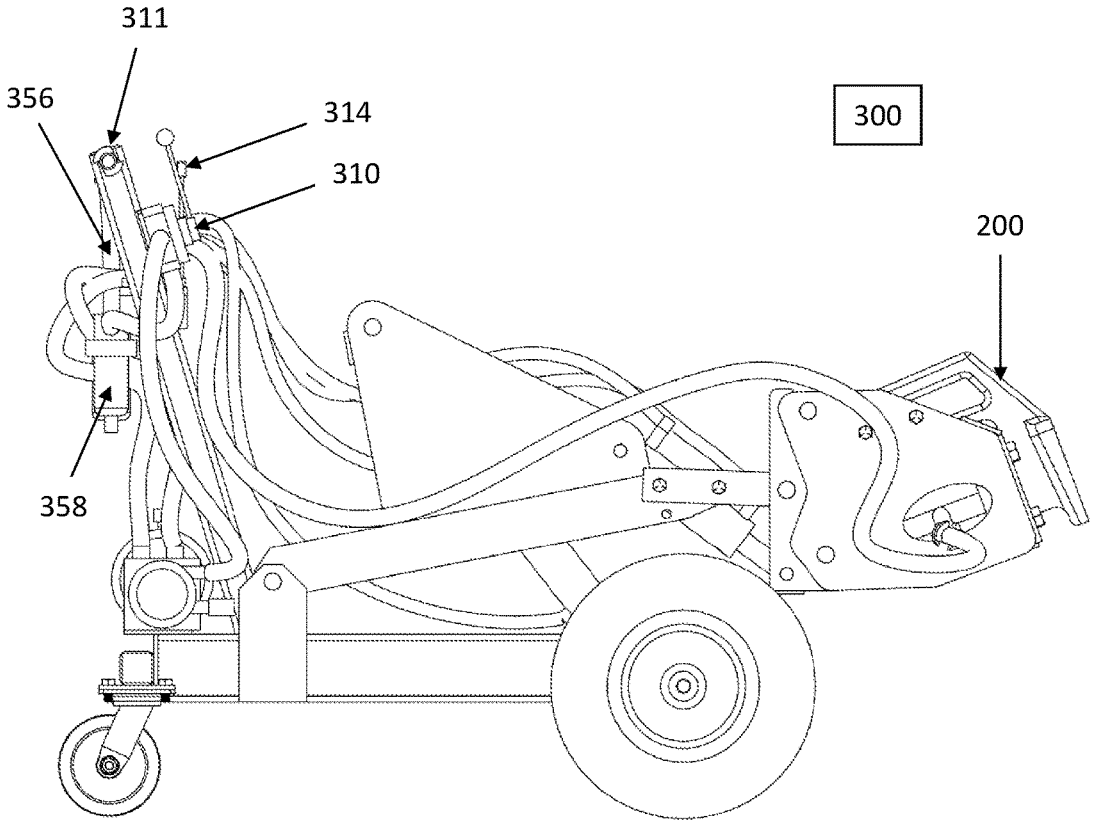

Referring now to FIGS. 3A-3C, an example railcar vibrator lifter 300 is shown, according to various embodiments. As shown in FIG. 3A, railcar vibrator 200 may be coupled to vibrator adapter housing 302, which is configured to retain railcar vibrator 200 during transport and use. As would be appreciated, vibrator adapter housing 302 may be adapted to accommodate any number of different shapes and sizes of railcar vibrators (e.g., a rotary style vibrator such as vibrator 202B, etc.). For example, the frame of vibrator adapter housing 302 may be shaped to allow a pneumatic line to reach the corresponding fitting of railcar vibrator 200, regardless of where the fitting is located on railcar vibrator 200.

To operate railcar vibrator 200 using lifter 300, power (including electric, pneumatic, or hydraulic power) is provided to raise and lower the lifter as well as to maneuver and operate the railcar vibrator. A single power input may be used for both, or, alternatively, multiple types can provided, used separately or in sequence. In a particular embodiment, a source of pressurized air can be attached to connector 311 providing pressurized air through handle 355 and pressure supply line 356 to pressurize pressure valve 310 (after passing through optional air filter 357 and lubricator/oiler 358). Connector 311 allows a power source to be readily coupled and decoupled from lifter 300 (e.g., using a crows foot configuration, etc.). Pressure valve 310 may be used to direct pressure (e.g., pneumatic pressure, etc.) to motor/pump 312 through motor input line 309 or to railcar vibrator 200 through vibrator input line 308. In one embodiment, connector 304 may mate vibrator input line 308 to inlet line 306 of railcar vibrator 200. Connector 304 may, for example, be configured to allow vibrator input line 308 to be selectively coupled and decoupled from inlet line 306 (e.g., using a crows foot configuration, etc.).

In one embodiment, pressure valve 310 may have three settings. In the first setting, pressure valve 310 may prevent all pressure supplied via pressure supply line 356 from being supplied beyond pressure valve 310 (e.g., a "neutral" setting). In the second setting, pressure valve 310 may provide pressurized gas or liquid to vibrator input line 308, thereby actuating vibrator 200. In the third setting, pressure valve 310 may supply pressure to the motor of motor/pump 312, with the pump of motor/pump 312 generating a separate pressure carried by control lines 307 to the positioning system of lifter 300, as controlled by controls 314. As described in greater detail below, controls 314 may be operated to adjust the height and/or angle of railcar vibrator 200.

As shown, lifter 300 may also include mechanisms to raise/lower railcar vibrator 200 and/or to adjust the angle of railcar vibrator 200. Notably, controls 314 may be operable to provide pressure along lines 316, if pressure valve 310 is in the corresponding position to provide pressure to motor/pump 312 which provides pressure to the vibrator adjustment mechanisms. In various embodiments, lifter 300 may include one or more cylinders (e.g., linear actuating cylinders), such as height-adjustment cylinder 318 and angle adjustment cylinder 320, that are coupled to controls 314 via lines 316. Thus, controls 314 may be used to actuate cylinders 318 and 320 as desired, thereby repositioning vibrator 200. For example, cylinder 318 may be actuated to raise or lower railcar vibrator 200 (e.g., by pushing against the lower frame of lifter 300, such as at bracket 340). Similarly, cylinder 320 may be actuated to rotate vibrator adapter housing 302 and vibrator 200 about an axis that runs through lifter 300 such that the angle of vibrator 200 can be adjusted.

In various embodiments, lifter 300 may include two or more front wheels 324 coupled to a main axle that extends through the base of lifter 300. Also as shown, lifter 300 may include one or more rear wheels 322. In one embodiment, rear wheels 322 may be of a caster style, thereby allowing lifter 300 to be easily maneuvered. For example, rear wheels 322 may be rubber coated caster wheels, which may facilitate lifter 300 being maneuvered over loose cargo (e.g., grains, etc.) or other small obstacles. One or more of rear wheels 322 may also include a caster locking mechanism, to prevent movement of lifter 300 when not in use. In some embodiments, front wheels 324 may be much larger than wheels 322, to provide greater support and stability to vibrator 200, as well as to enable the lifting of heavier vibrators. Further, in one embodiment, front wheels 324 may comprise foam-filled tires, thereby making wheels 324 virtually maintenance free.

FIG. 3B shows an example view of the front of railcar vibrator lifter 300, in some embodiments. As shown, lifter 300 may include one or more retention structures 330 that are configured to engage vibrator adapter housing 302. As noted previously, vibrator adapter housing 302 may be adapted for use with any number of different types of railcar vibrators. Thus, retention structures 330 may be used in a universal manner, to retain and position any number of different types of railcar vibrators, so long as the corresponding vibrator adapter housings are capable of engaging retention structures 330.

Also as shown, actuation of angle adjustment cylinder 320 may cause retention structures 330 to rotate about an axis that extends substantially parallel to the front axle of lifter 300. When vibrator adapter housing 302 is coupled to retention structures 330, actuation of cylinder 320 (e.g., via controls 314) will cause vibrator adapter housing 302 to similarly rotate about the axis, thereby adjusting the approach angle of railcar vibrator 200. When pressure is supplied to cylinder 318, cylinder 318 may push the upper portion of lifter 300 that includes retention structures 330 away from the base of lifter 300, thereby raising retention structures 330 in a direction that is substantially perpendicular to the ground. Conversely, when pressure is relieved from cylinder 318, retention structures 330 may be lowered. In this way, cylinder 318 may be actuated to raise or lower the coupled railcar vibrator 200 as desired.

FIG. 3C depicts a side view of lifter 300, according to various embodiments. As is apparent from this view, the overall length of lifter 300 is relatively short, and the compact design shown allows lifter 300 to have greater maneuverability. In addition, the handle of lifter 300 may also be shortened, thereby preventing pinch conditions from occurring between the handle and other obstructions such as nearby railcars.

Figure 4A:
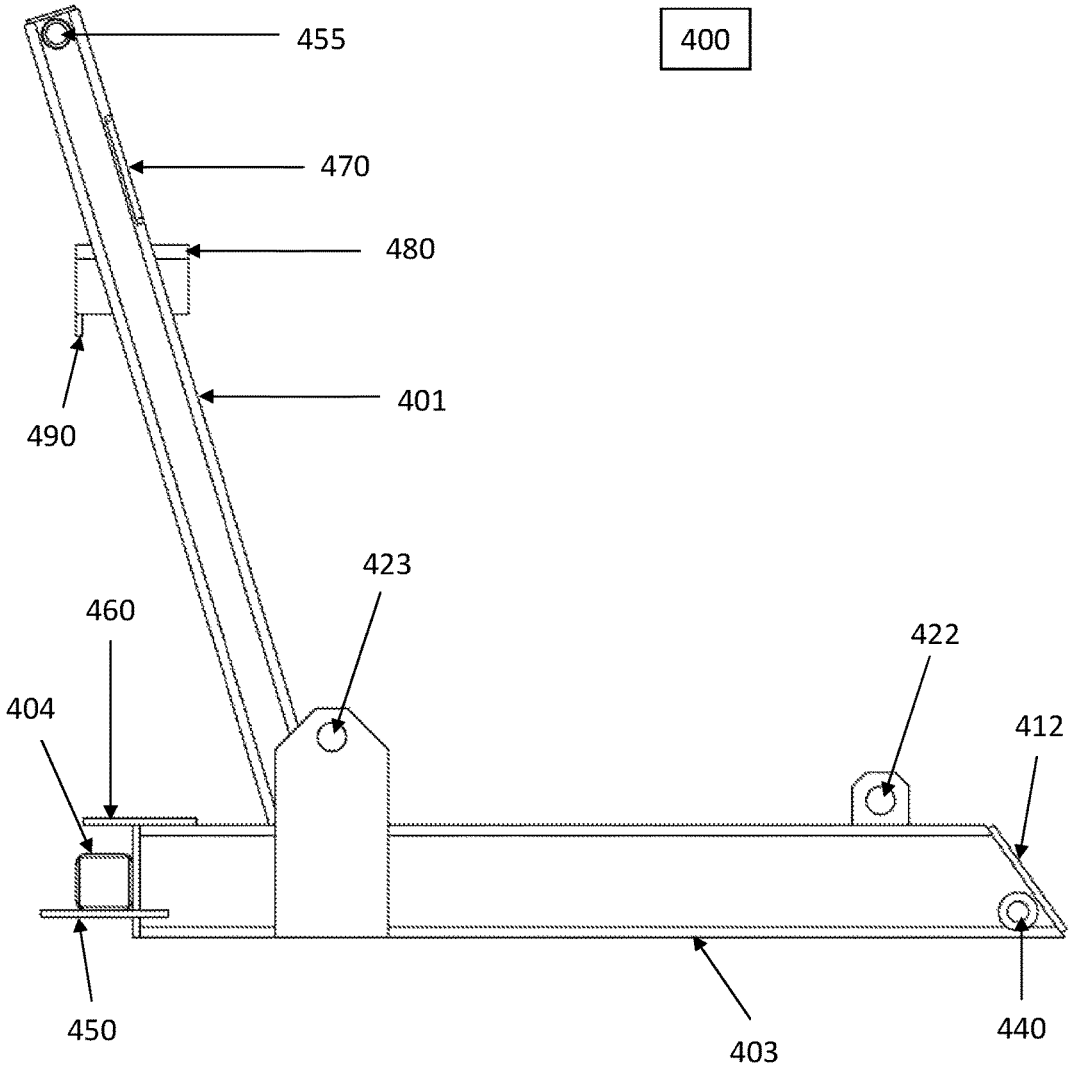
FIGS. 4A-4C illustrate example views of a first subassembly for a railcar vibrator lifter, according to various embodiments, where
Figure 4B:
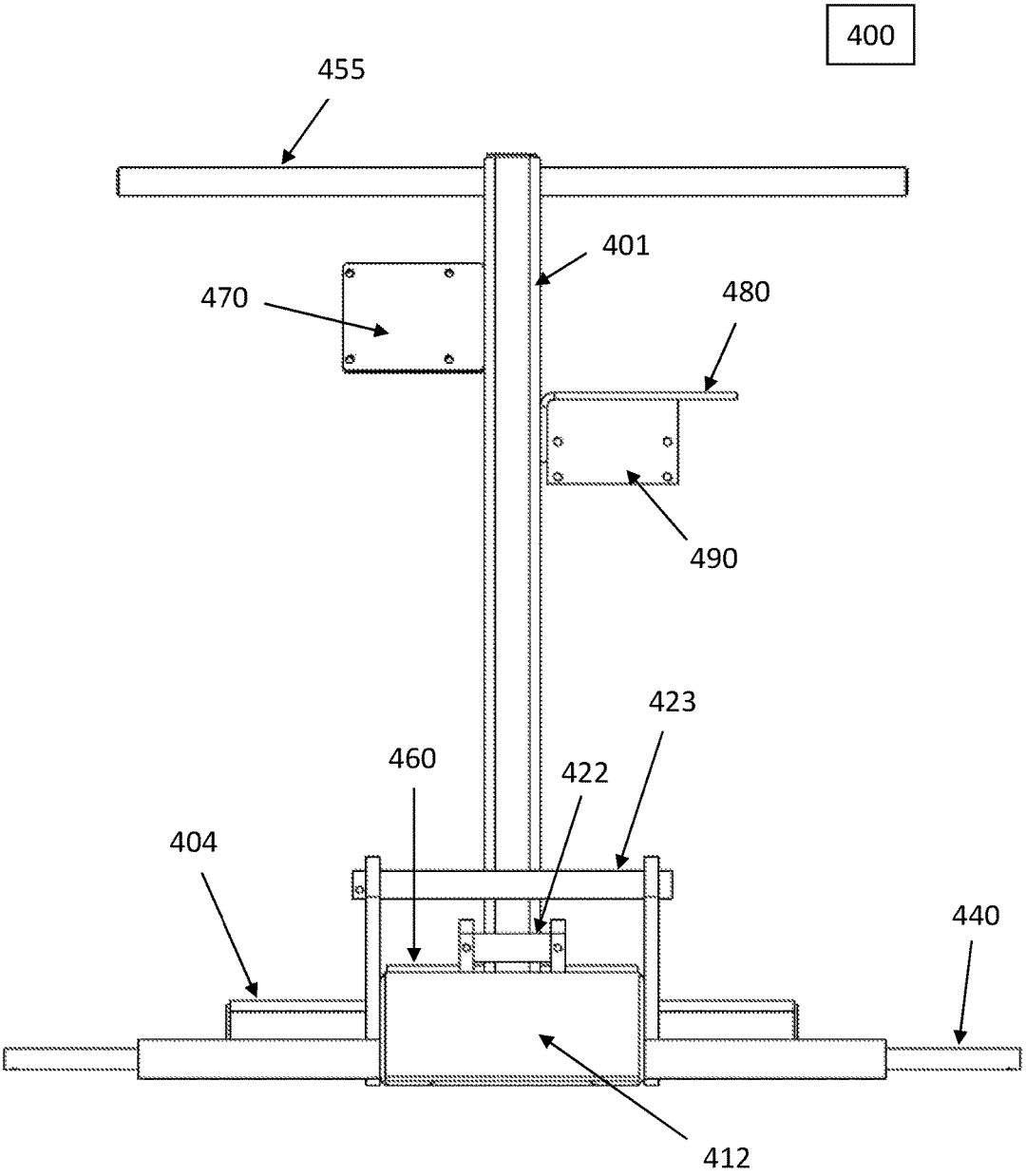
Figure 4C:
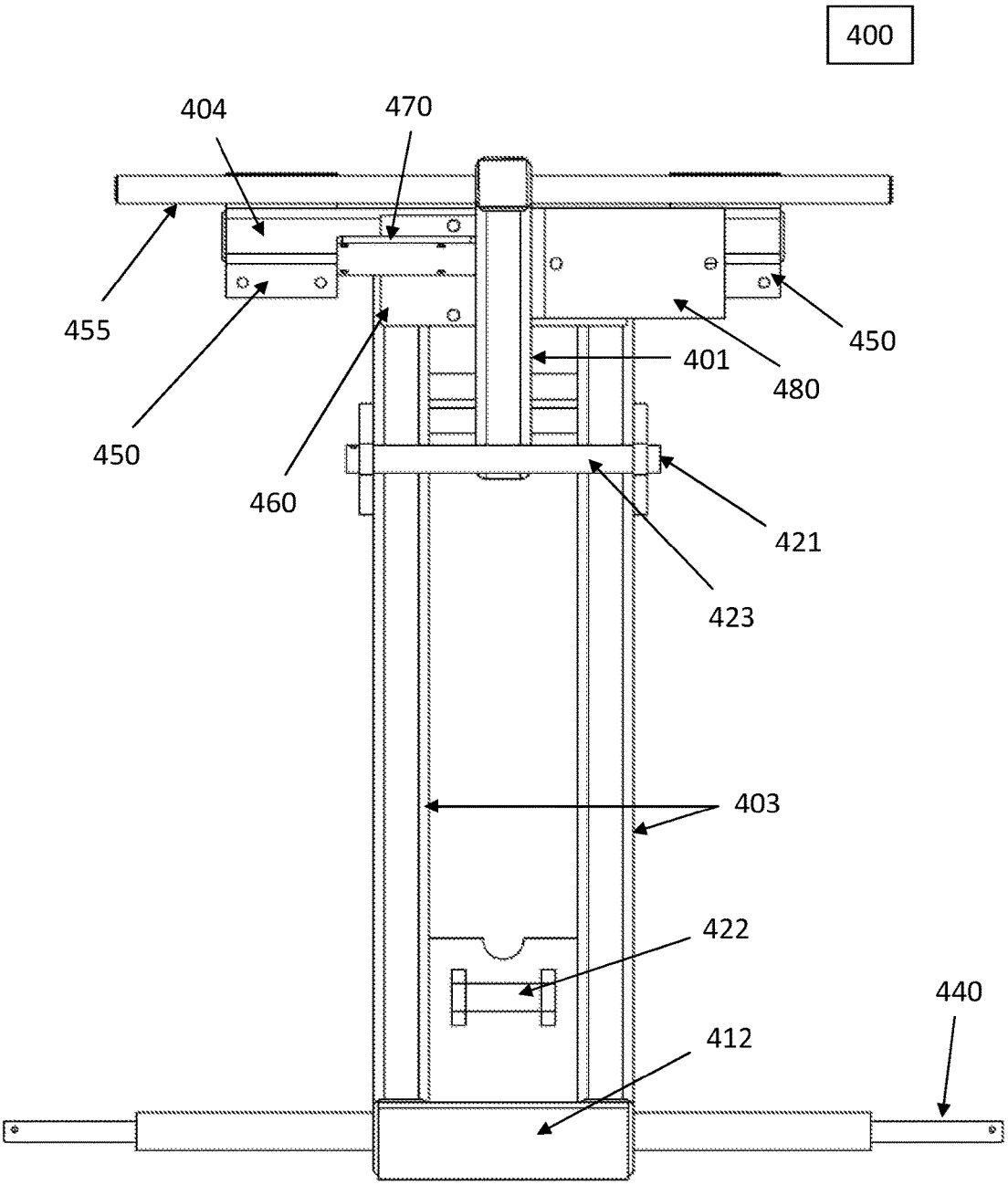

Referring now to FIGS. 4A-4C, example views are shown of a first subassembly for a railcar vibrator lifter, according to various embodiments. FIG. 4A is a side view, FIG. 4B is a front view, and FIG. 4C is a top view of base subassembly 400. As shown, the base of the lifter may be formed in part using parallel members 403. Members 403 may include corresponding apertures to accommodate front axle 440 of the lifter, to which wheels 324 may be coupled. In one embodiment, members 403 may include hollow, tubular structures through which front axle 440 may be inserted, to provide greater support to the front axle. Front cap 412 may be coupled to parallel members 403, thereby connecting members 403. On the opposing side of front cap 412, cross member 404 may connect parallel members 403. As shown particularly in FIG. 4C, caster plates 450 may be coupled to cross member 404. In one embodiment, rear wheels 322 described previously may be attached to these caster plates.

Motor plate 460 may also be affixed to parallel members 403 as shown and/or to cross member 404 as needed. This motor plate may be configured to provide a base to which motor/pump 312 may be attached. For example, fasteners such as bolts may be used to retain motor/pump 312 to the depicted motor plate.

Handle 455 may be coupled to the top of upright 401 forming a vertical handle structure, and the upright may further be coupled to handle retention pin 421 that extends between parallel members 403. As would be appreciated, the location of the handle and upright 401 in front of the motor shortens the overall lifter dimension, which is critical to the user in most limited space operating environments. As an example, locating the handle at the position shown (e.g., as opposed to at the back end of the lifter) may reduce the overall length of the lifter by upwards of nine inches. Further, the compact design shown, including the handle position, shortened frame length, the position of front wheels 324, and the heavy duty framework allow for the lifter to be used in even tighter spaces.

In some embodiments, additional weight may be added to upright 401, cross member 404, the rearward portions of parallel members 403, or the like, to allow greater weight to be lifted by retention structures 330. Also as shown air valve plate 470 may be coupled to upright 401 to which pressure valve 310 may be attached. Similarly, controls plate 480 and oiler plate 490 may be coupled to upright 401 to retain portions of the height/angle adjustment mechanism, such as controls 314, and air preparation components, such as the oiler and filter respectively.

Figure 5A:
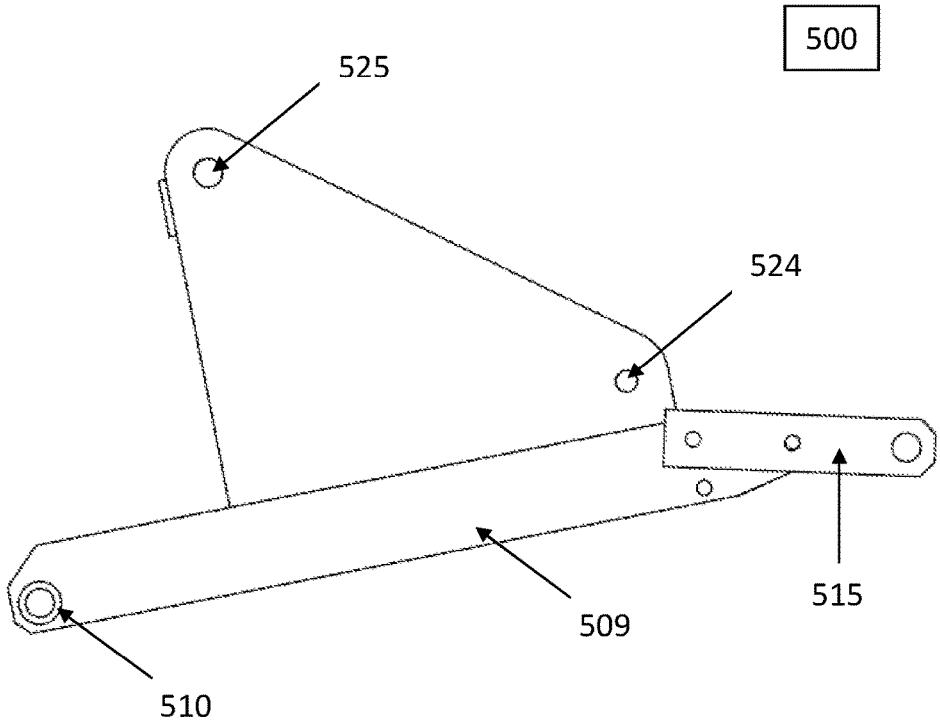
FIGS. 5A-5C illustrate example views of a second subassembly for a railcar vibrator lifter, according to various embodiments.
Figure 5B:
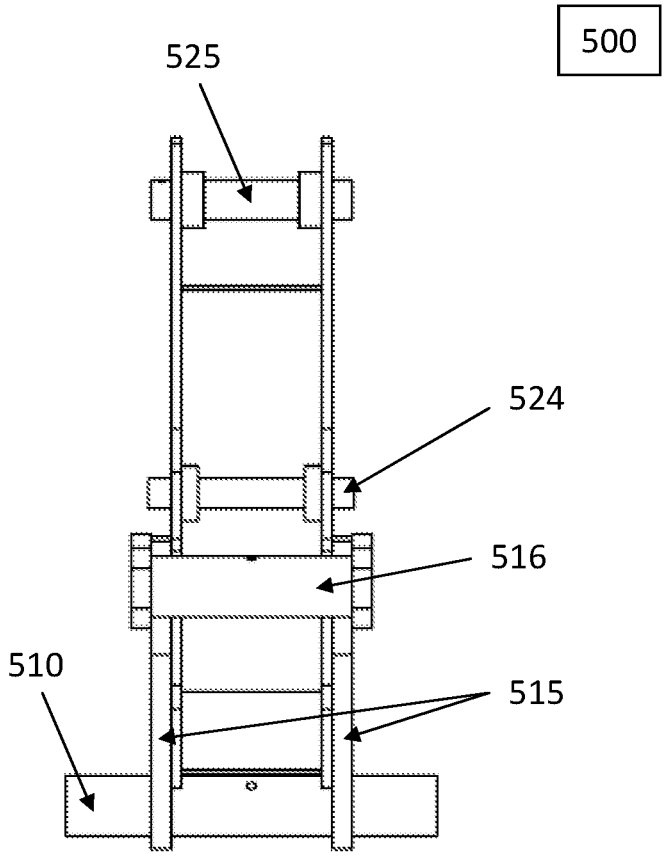
Figure 5C:
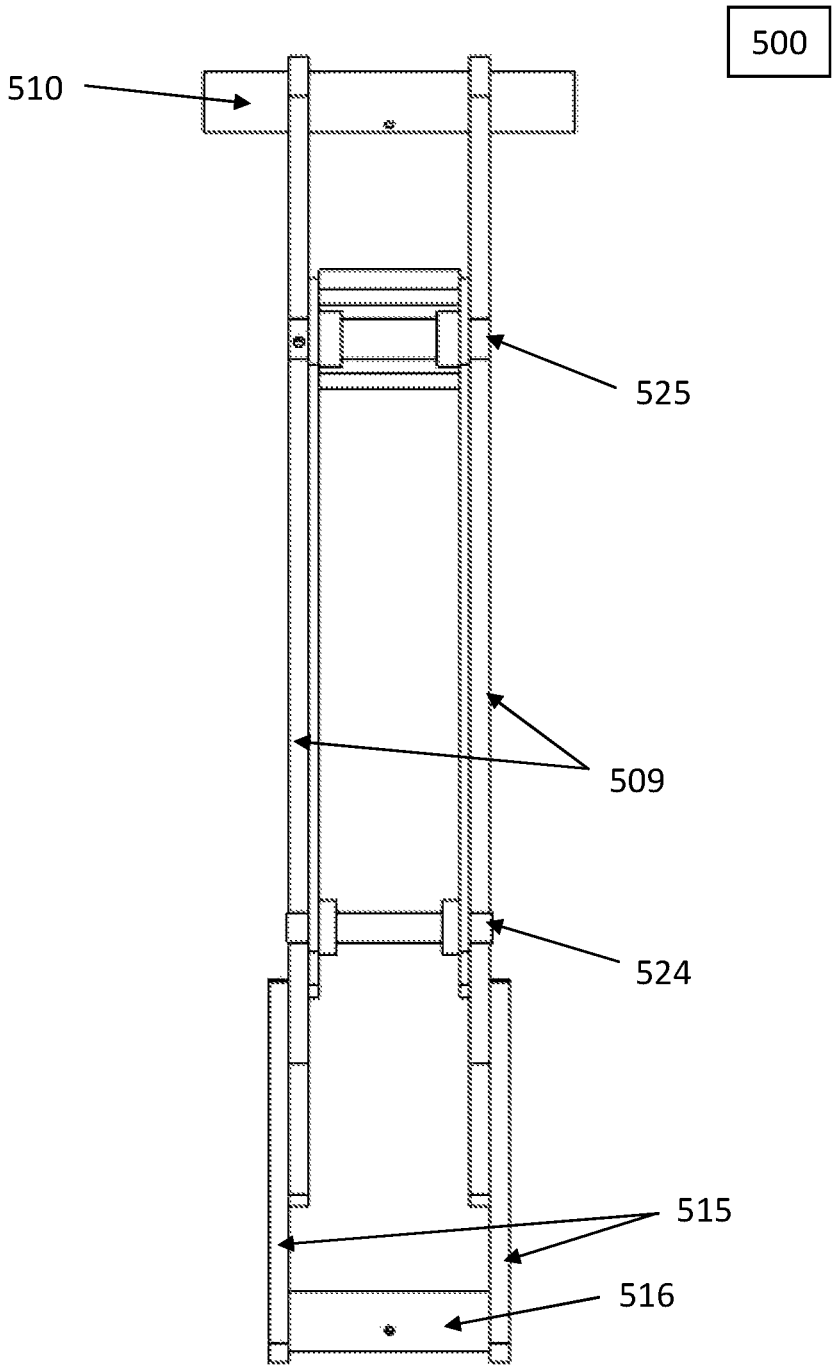

Referring now to FIGS. 5A-5C, a second subassembly is shown, according to various embodiments. FIG. 5A is a side view, FIG. 5B is a front view, and FIG. 5C is a top view of upper subassembly 500. In general, subassembly 500 may be located above subassembly 400 and include parallel members 509. In some embodiments, subassembly 500 may be attached to the base subassembly 400 via mounting pins 422 and 423 shown in FIGS. 4A-4C. In particular, height-adjustment cylinder 318 may be coupled to pin 422 of the base subassembly 400 and to upper mounting pin 525 of subassembly 500, as shown in FIGS. 5A-5C. The rearward portion of subassembly 500 may be coupled to base subassembly 400 via cross member 510 through which pin 423 may be inserted. During actuation of cylinder 318, subassembly 500 may be rotated about the axis defined by pin 423, thereby raising or lowering the height of the front portion of subassembly 500 relative to the ground.

Figure 6A:
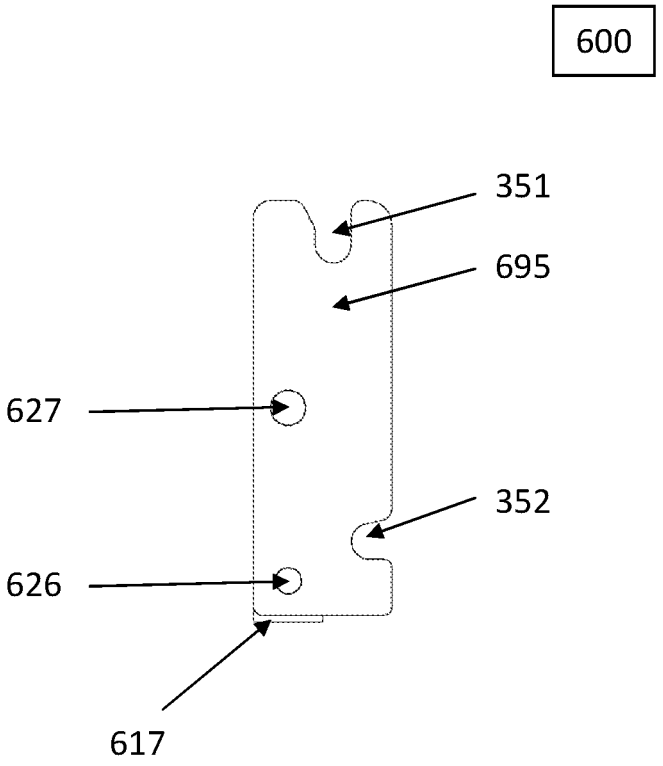
FIGS. 6A-6C illustrate example views of a third subassembly for a railcar vibrator lifter, according to various embodiments.
Figure 6B:
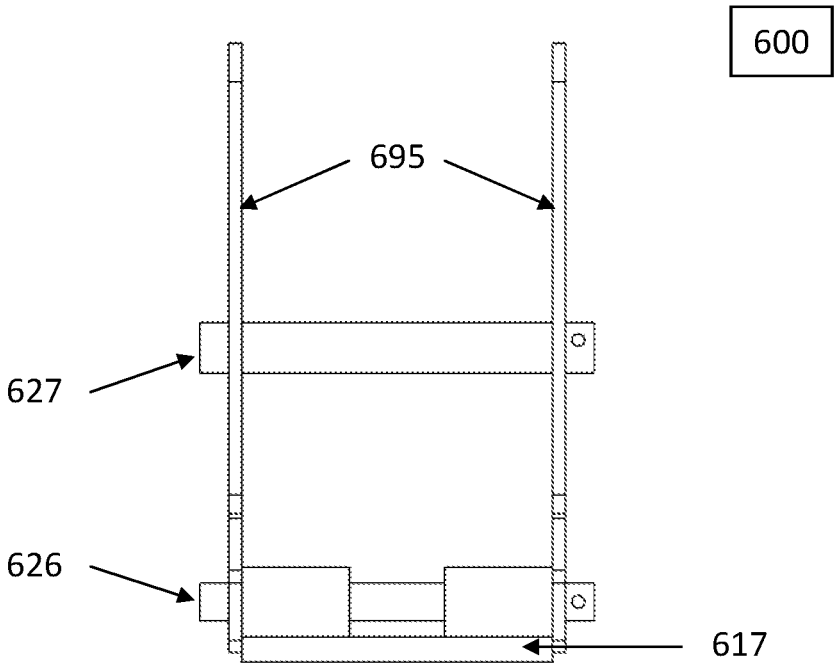
Figure 6C:
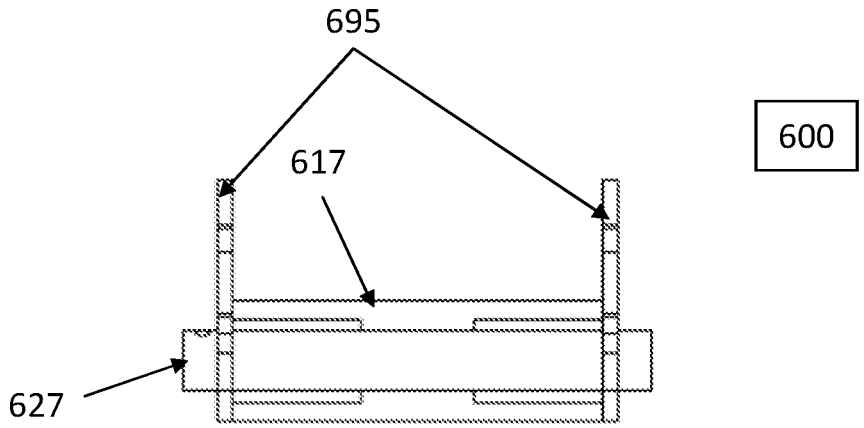

Coupled to the front portion of subassembly 500 may be extended members 515 to which retention structures 330 described earlier may be attached. A third subassembly forming retention structures 330 is shown in greater detail in FIGS. 6A-6C, according to various embodiments. FIG. 6A is a side view, FIG. 6B is a front view, and FIG. 6C is a top view of hook plate subassembly 600. As shown, the retention structures of subassembly 600 may include parallel hook plates 695, each coupled to cross member 617, to which vibrator adapter housing 302 may be removably coupled. For example, cross members 345 of vibrator adapter housing 302 may engage grooves 351 and 352 of hook plates 695 (also shown in FIGS. 3A-3C) to couple the housing to the lifter. Cross pin 627 may extend through the cross member 516 shown in FIGS. 5A-5C, thereby coupling hook plate subassembly 600 to the upper subassembly 500.

The angle adjustment cylinder 320 described previously may be coupled at one end to upper subassembly 500 via retention pin 524 in FIGS. 5A-5C and coupled at the opposing end to subassembly 600 via retention pin 626 in FIGS. 6A-6C. Actuation of cylinder 320 may then cause subassembly 600 and any structures coupled thereto (e.g., vibrator adapter housing 302 and vibrator 200) to rotate about the axis defined by pin 627, thereby adjusting the angle of the vibrator.

Figure 7A:
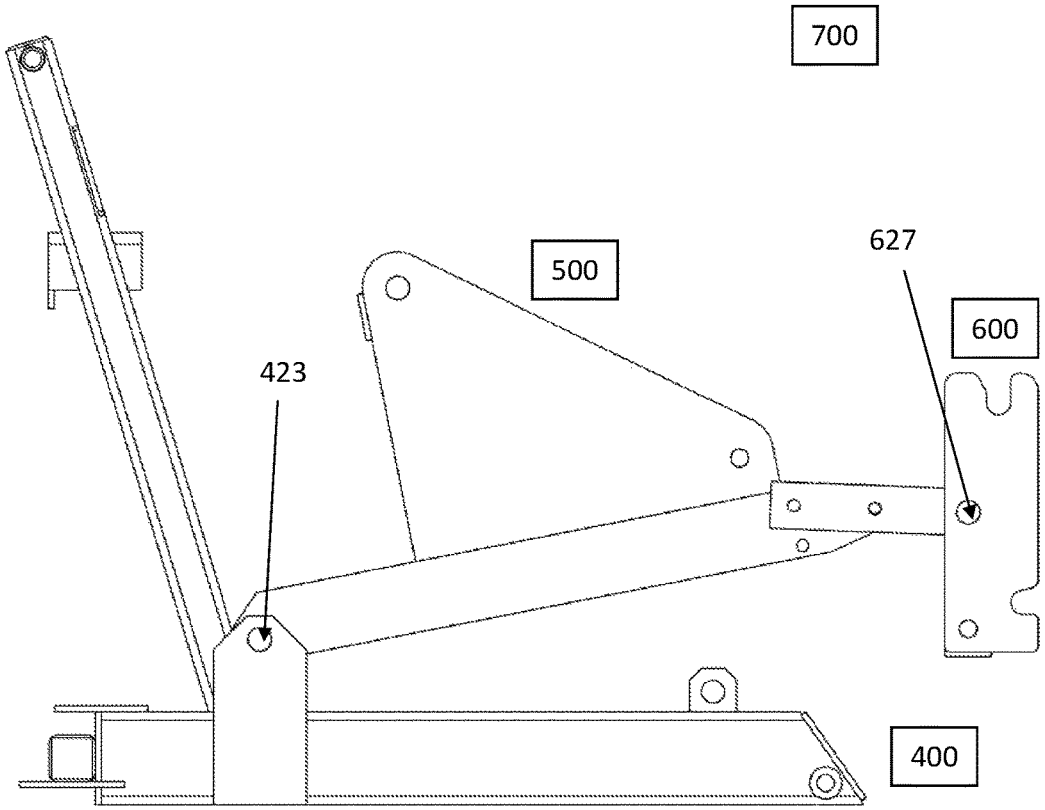
FIGS. 7A-7C illustrate example views of an assembly of first, second and third subassemblies to illustrate a completed lifter assembly of the for a railcar vibrator lifter according to the various embodiments.
Figure 7B:
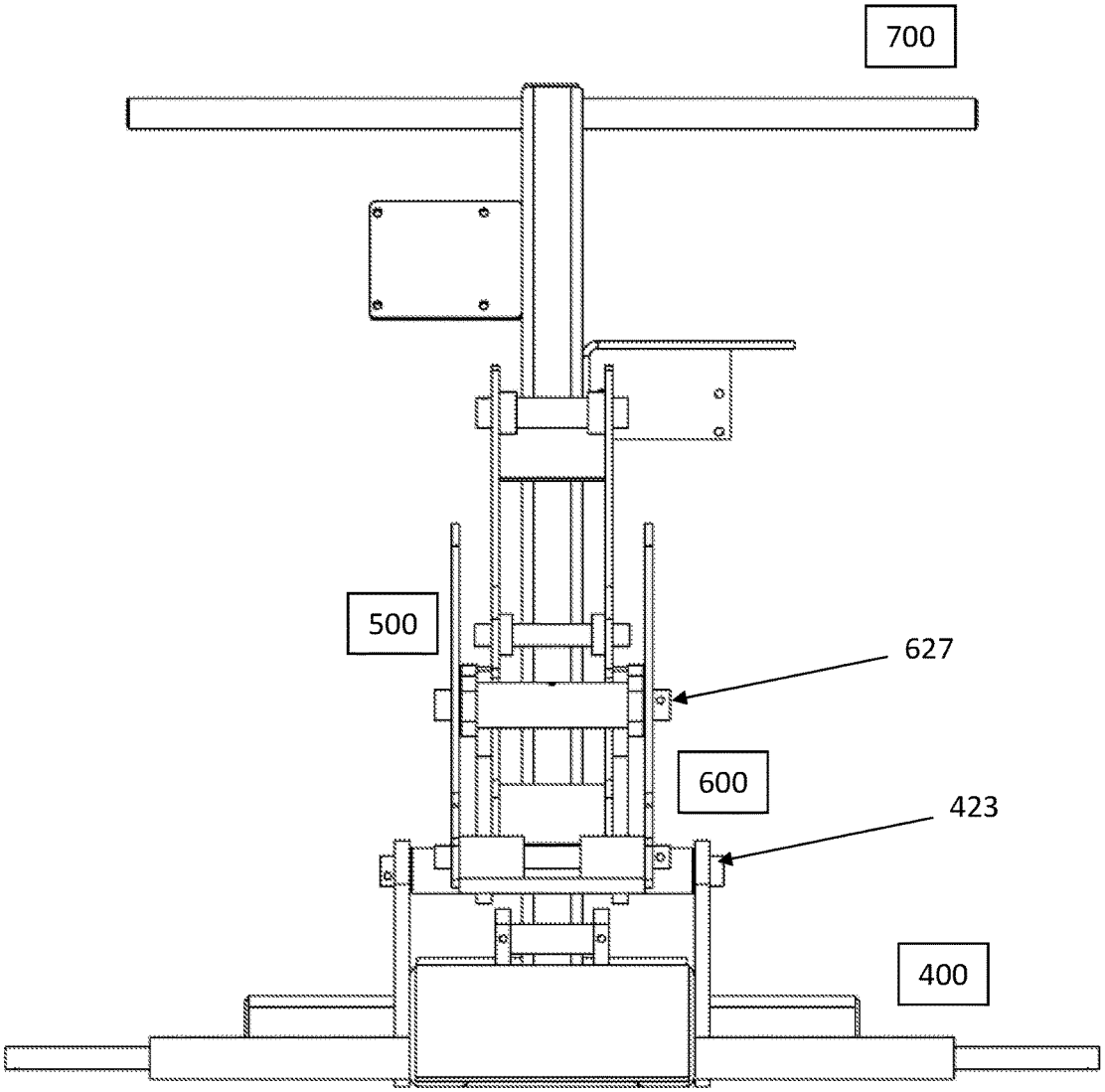
Figure 7C:
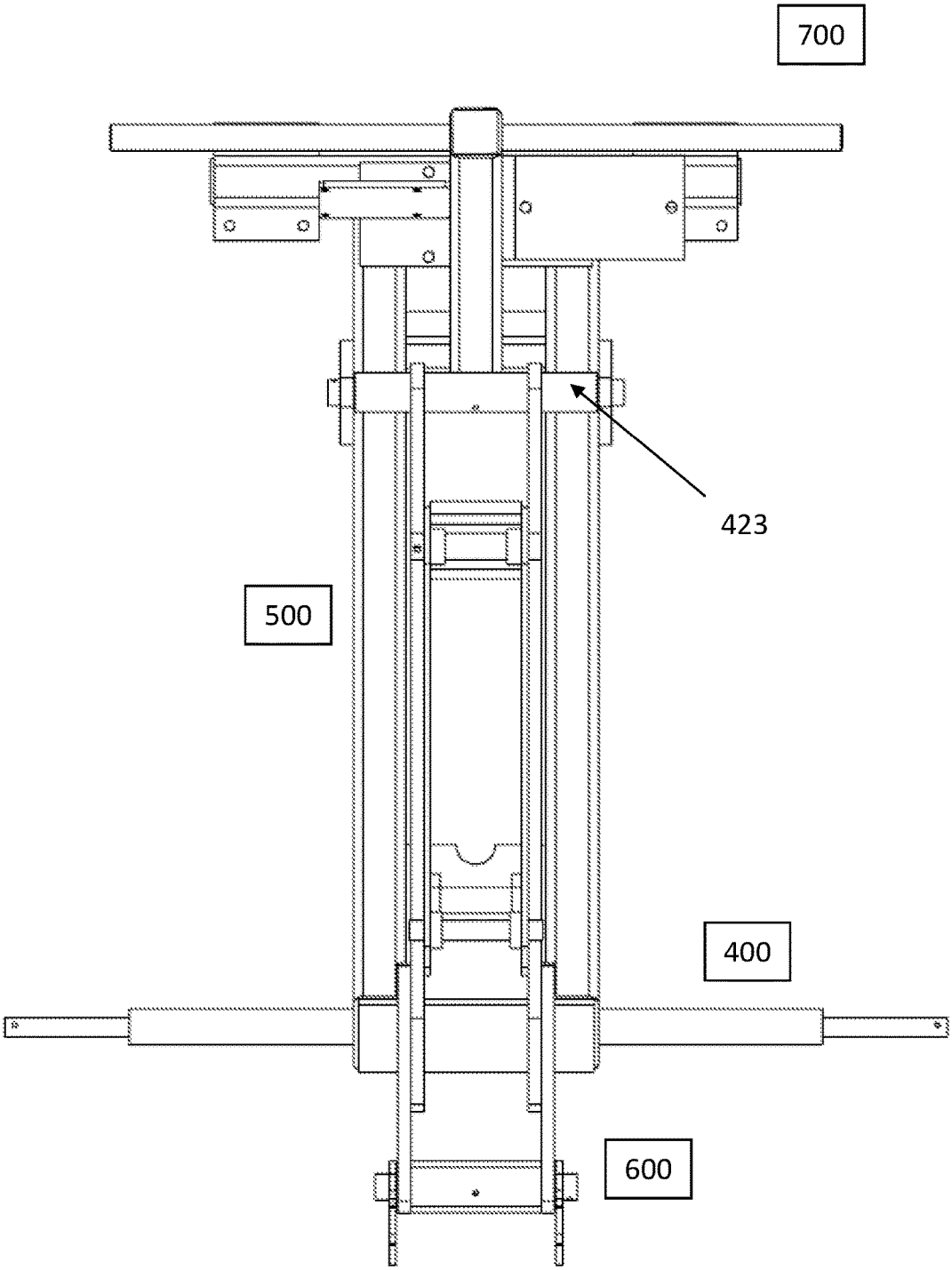

FIGS. 7A-7C illustrate example views of subassemblies 400-600 assembled into a complete lifter frame assembly. FIG. 7A is a side view, FIG. 7B is a front view, and FIG. 7C is a top view of completed lifter assembly 700. As shown and described above, pin 423 may be used to couple upper subassembly 500 to base subassembly 400, thereby allowing upper subassembly 500 to pivot about the corresponding axis of pin 423. At the front of the lifter assembly 700, pin 627 may be used to couple hook plate subassembly 600 to upper subassembly 500, also providing a second axis of rotation. In particular, an actuator such as cylinder 320 may cause subassembly 600 to rotate about the axis corresponding to pin 627, thereby adjusting the angle at which subassembly 600 (and vibrator 200) is positioned.

An example operating procedure to install a railcar vibrator using the lifter described above is as follows:

1) Maneuver the vibrator lifter in front of the retainer coupled to an unloading mechanism on a railcar.
2) Ensure the air pressure valve control is set for the unit's hydraulics (e.g., to the left).
3) Raise the vibrator adapter housing and vibrator of the lifter above the retainer and adjust its angle to closely match the angle of the railcar retainer.
4) Push the lifter toward the railcar and lower the vibrator adapter housing and vibrator into the railcar retainer.
5) Lower the lifter using the controls (e.g., the left-hand lifter height controls) to disconnect the lifter from the vibrator adapter housing (leaving the vibrator installed in the railcar retainer).
6) Turn the air pressure valve control (e.g., all the way to the right) to set it to engage the vibrator.

An example operating procedure to remove a railcar vibrator using the lifter described above is as follows:

1) Once the railcar is empty, deactivate the vibrator by shifting the air pressure control valve (e.g., all the way to the left), engaging the unit's hydraulics once again.
2) Reconnect the vibrator retention structures to engage the vibrator adapter housing and vibrator by adjusting the height and angle using the controls (e.g., the left-hand lifter height and angle controls).
3) Once connected to the vibrator adapter housing and vibrator, lift the vibrator from the retainer on the railcar unloading mechanism (e.g., by using the height and angle controls). Adjustments to height and angle may be required as the vibrator clears the railcar retainer.
4) If the front portion of the vibrator becomes stuck in the railcar retainer, a short burst of power to the vibrator may be necessary to nudge the vibrator loose and release it from the railcar retainer.
5) Once the vibrator is completely clear of the railcar retainer, shift the air pressure valve control in the neutral position (this disengages both the hydraulics and the vibrator from air power).
6) Maneuver the vibrator lifter back away from the railcar.
7) Engage the rear right caster lock of the unit to prevent unexpected movement when the vibrator lifter is not in use.

While there have been shown and described illustrative embodiments that provide for a railcar vibrator lifter, it is to be understood that various other adaptations and modifications may be made within the spirit and scope of the embodiments herein, with the attainment of some or all of their advantages. For instance, while the techniques herein are described primarily with respect to a lifter for railcar vibrators, the teachings herein are not limited as such and may be adapted for use with other forms of non-railcar hopper vibrators, accordingly.

What is claimed is:

1. A railcar vibrator lifter comprising:

a base assembly comprising a handle structure attached to a base;

an upper assembly rotatably coupled to the base assembly; and a hook plate assembly rotatably attached to the upper assembly, wherein the hook plate assembly includes:

one or more retention structures rotatably attaching the hook plate assembly to the upper assembly, a railcar vibrator adapter housing removably coupled to the one or more retention structures, the railcar vibrator adapter housing capable of receiving a railcar vibrator positioned within the railcar vibrator adapter housing, and one or more cylinders attached to both the upper assembly and the railcar vibrator adapter housing to actuate the railcar vibrator housing through hydraulic pressure and rotate the railcar vibrator adapter housing to different angles.

2. The railcar vibrator lifter of claim 1, wherein the railcar vibrator adapter housing is rotatable to raise and lower the railcar vibrator positioned within the railcar vibrator adapter housing.

3. The railcar vibrator lifter of claim 1, wherein the one or more retention structures include parallel hook plates, each comprising at least one groove in which the railcar vibrator adapter housing is removably coupled.

4. The railcar vibrator lifter of claim 1, wherein the upper assembly is rotatable to be raised and lowered relative to the base assembly.

5. The railcar vibrator lifter of claim 4 further comprising at least one height adjustment cylinder coupled to the upper assembly and to the base of the base assembly and configured to raise and lower the upper assembly.

6. The railcar vibrator lifter of claim 1, wherein the base assembly and the hook plate assembly are attached to the upper assembly at opposite ends.

7. The railcar vibrator lifter of claim 1 further comprising one or more front wheels and one or more rear wheels.

8. The railcar vibrator lifter of claim 7, wherein the base assembly further comprises at least one axle.

9. The railcar vibrator lifter of claim 8, wherein the base assembly has a front end and a back end and wherein the axle is coupled to the front end of the base assembly and the handle structure is attached to the back end of the base assembly.

10. The railcar vibrator lifter of claim 9, wherein the railcar vibrator lifter comprises two front wheels on the axle and two rear wheels attached to the base assembly.

11. The railcar vibrator lifter of claim 10, wherein the front wheels are larger than the rear wheels.

12. The railcar vibrator lifter of claim 10, wherein the rear wheels are caster wheels.

13. The railcar vibrator lifter of claim 1, further comprising one or more power sources to raise and lower the railcar vibrator adapter housing.

14. The railcar vibrator lifter of claim 13 comprising a single power source.

15. The railcar vibrator lifter of claim 1, wherein the one or more cylinders are two or more cylinders, and the base assembly further comprises:

a motor and pump that apply pressure to the two or more cylinders; and at least one attached pressure valve to direct pressure to the motor and pump through an input line.

16. The railcar vibrator lifter of claim 15, wherein the motor and pump generate hydraulic or pneumatic pressure to adjust the railcar vibrator adapter housing height or angle.

17. The railcar vibrator lifter of claim 16, wherein the base assembly further comprises at least one control to actuate the one or more cylinder to raise, lower, and rotate the railcar vibrator adapter housing.

* * * * *